US010327557B2

(12) United States Patent
Neil et al.

(10) Patent No.: US 10,327,557 B2
(45) Date of Patent: Jun. 25, 2019

(54) MODULAR SEATING SYSTEM

(71) Applicants: Gary Neil, Mississauga (CA); Nicholas Brian Gillissie, Toronto (CA)

(72) Inventors: Gary Neil, Mississauga (CA); Nicholas Brian Gillissie, Toronto (CA)

( * ) Notice: Subject to any disclaimer, the term of this patent is extended or adjusted under 35 U.S.C. 154(b) by 0 days.

(21) Appl. No.: 15/621,250

(22) Filed: Jun. 13, 2017

(65) Prior Publication Data

US 2017/0354262 A1 Dec. 14, 2017

Related U.S. Application Data

(60) Provisional application No. 62/349,197, filed on Jun. 13, 2016.

(51) Int. Cl.

| | |
|---|---|
| ***A47C 4/02*** | (2006.01) |
| ***A47C 13/00*** | (2006.01) |
| ***A47C 7/02*** | (2006.01) |
| ***A47C 17/04*** | (2006.01) |
| *A47C 3/00* | (2006.01) |

(52) U.S. Cl.

CPC ..... *A47C 13/005* (2013.01); *A47C 7/02* (2013.01); *A47C 17/04* (2013.01); *A47C 3/00* (2013.01)

(58) Field of Classification Search

CPC ..... A47C 13/005; A47C 13/00; A47C 15/002; A47C 7/54; A47C 7/546; A47C 7/40; A47C 7/42; A47C 7/02; A47B 83/02; A47B 83/024; A47B 83/045; A47B 37/04

USPC ..... 297/440.14, 451.8, 232, 248, 440.1, 297/440.15, 440.22; D6/708, 708.21, D6/329, 335

See application file for complete search history.

(56) References Cited

U.S. PATENT DOCUMENTS

| | | | | | |
|---|---|---|---|---|---|
| 2,279,864 | A * | 4/1942 | Eide | A47B 47/042 | 206/557 |
| 2,925,851 | A * | 2/1960 | Weiss | A47C 13/00 | 297/119 |
| 3,066,435 | A * | 12/1962 | Oddo | A47C 31/11 | 108/90 |
| 3,066,982 | A * | 12/1962 | Brower | A47C 4/02 | 297/411.28 |
| 3,099,482 | A * | 7/1963 | Woodruff, Sr. | A47C 7/62 | 297/188.09 |
| 3,608,959 | A * | 9/1971 | Sarvas | A47C 4/02 | 297/218.3 |
| 3,669,495 | A * | 6/1972 | Von Rudgisch | A47C 4/02 | 297/440.15 |
| 3,672,723 | A * | 6/1972 | Decursu | A47B 85/04 | 297/440.24 |

(Continued)

*Primary Examiner* — Kyle J. Walraed-Sullivan
(74) *Attorney, Agent, or Firm* — Lorelei G. Graham

(57) ABSTRACT

A modular seating system including at least two horizontally oriented support members and at least one core base component of recycled plastic having a top and a bottom adapted to engage the horizontally oriented support members. The plastic core base component includes a series of feature attachment points molded directly into the top and the bottom of the plastic core base component, and the bottom of the plastic core base component includes defined receptacles for at least four vertical support members. The modular seating system may include a core back and armrest component adapted to engage the horizontally oriented support members and the core base component and the feature attachment points.

18 Claims, 21 Drawing Sheets

(56) References Cited

U.S. PATENT DOCUMENTS 3,756,657 A * 9/1973 Johnson ..... A47C 4/02 297/440.1
3,973,800 A * 8/1976 Kogan ..... A47C 13/005 297/440.23
4,124,251 A * 11/1978 Petersen ..... A47C 4/02 297/411.42
4,140,065 A * 2/1979 Chacon ..... A47C 4/021 108/156
4,350,390 A * 9/1982 Ogawa ..... A47C 5/00 297/452.18
4,523,787 A * 6/1985 Robinson ..... A47C 4/028 297/440.1
5,080,438 A * 1/1992 Moyer ..... A47C 4/028 297/440.23
5,265,939 A * 11/1993 Self ..... A47C 4/02 297/440.1
5,439,271 A * 8/1995 Ryan ..... B60N 2/68 297/218.5
5,509,720 A * 4/1996 Croom ..... A47C 13/005 297/181
5,738,414 A * 4/1998 Wieland ..... A47C 4/02 297/219.1
5,890,767 A * 4/1999 Chang ..... A47C 4/02 297/248
6,010,195 A * 1/2000 Masters ..... B60N 2/0232 297/452.55
6,209,952 B1 * 4/2001 Huang ..... A47B 39/00 297/143
6,241,317 B1 * 6/2001 Wu ..... A47C 4/02 297/440.1
7,240,967 B2 * 7/2007 Wade ..... A47C 4/02 297/440.1
7,837,273 B1 * 11/2010 Ratza ..... B60N 2/24 297/452.49
8,393,685 B2 * 3/2013 Hill ..... A47C 11/00 297/440.13
8,764,114 B1 * 7/2014 Frank ..... A47C 4/028 297/248
8,777,319 B2 * 7/2014 Brandtner ..... A47C 4/02 29/91.1
9,004,585 B1 * 4/2015 Pidgornyy ..... A47C 13/005 297/127
9,149,124 B1 * 10/2015 Savovic ..... A47C 7/24
9,480,337 B2 * 11/2016 Xie ..... A47C 3/025
D778,655 S * 2/2017 Chiu ..... D6/708
9,668,581 B1 * 6/2017 Hill ..... A47C 4/02
9,820,576 B2 * 11/2017 McCullough ..... A47C 4/02
9,986,833 B1 * 6/2018 Reid ..... A47C 1/12
2002/0096095 A1 * 7/2002 Dodd ..... A47B 83/02 108/186
2005/0140184 A1 * 6/2005 Williams ..... A47B 83/00 297/135
2005/0161985 A1 * 7/2005 Austin ..... A47C 7/748 297/180.12
2005/0168041 A1 * 8/2005 Glance ..... B60N 2/68 297/452.18
2005/0179303 A1 * 8/2005 Owens ..... A47C 4/02 297/440.1
2005/0217022 A1 * 10/2005 Oldham ..... A47C 13/005 5/52
2006/0033368 A1 * 2/2006 Longnecker ..... A47C 4/02 297/248
2006/0279124 A1 * 12/2006 White, III ..... A47C 13/005 297/440.14
2008/0157571 A1 * 7/2008 Richardson ..... A47C 4/02 297/188.1
2008/0191538 A1 * 8/2008 Berg ..... A47C 4/021 297/440.14
2009/0001775 A1 * 1/2009 Smith ..... A47B 83/02 297/135
2009/0235451 A1 * 9/2009 Gorkin ..... A47C 4/022 5/12.2
2010/0244536 A1 * 9/2010 Chen ..... A47C 4/02 297/440.15
2011/0233976 A1 * 9/2011 Hanson ..... A47C 4/02 297/217.1
2012/0080910 A1 * 4/2012 Davis ..... A47B 47/0075 297/118
2012/0112514 A1 * 5/2012 Hsu ..... A47C 7/022 297/452.41
2012/0119629 A1 * 5/2012 Nelson ..... A47B 87/00 312/111
2012/0212021 A1 * 8/2012 Hunter ..... A47C 4/02 297/232
2013/0129405 A1 * 5/2013 Everett ..... A47B 13/088 403/66
2013/0134763 A1 * 5/2013 Koch ..... F16B 21/09 297/440.23
2013/0147244 A1 * 6/2013 Carter, III ..... A47C 13/005 297/217.6
2013/0234576 A1 * 9/2013 Hixson ..... A47C 13/005 312/265.5
2014/0062145 A1 * 3/2014 Iacovoni ..... A47B 83/02 297/135
2014/0077572 A1 * 3/2014 Vander Veen ..... A47C 1/032 297/452.1
2014/0139000 A1 * 5/2014 Ogg ..... A47C 1/124 297/411.2
2014/0312661 A1 * 10/2014 Behar ..... A47C 7/40 297/135
2015/0061344 A1 * 3/2015 Yeh ..... A47C 17/02 297/440.1
2016/0095768 A1 * 4/2016 Gordon, Sr. ..... A61G 5/10 297/423.4
2016/0174715 A1 * 6/2016 Nelson ..... A47C 31/003 297/440.14
2016/0206100 A1 * 7/2016 Nelson ..... A47C 4/028
2016/0278529 A1 * 9/2016 Paterson ..... A47K 3/122
2016/0345739 A1 * 12/2016 McCullough ..... A47C 4/02
2017/0071354 A1 * 3/2017 Mezzera ..... A47C 4/028
2017/0295941 A1 * 10/2017 King ..... A47C 7/002
2017/0367486 A1 * 12/2017 Nelson ..... A47C 4/028
2018/0000244 A1 * 1/2018 Nelson ..... A47C 1/0352
2018/0213943 A1 * 8/2018 Kuhl ..... A47C 13/005

* cited by examiner

MODULAR SEATING SYSTEM

FIELD

This relates to the field of modular furniture, and in particular to a new and improved core for a modular seating system.

BACKGROUND

Traditional furniture designs have typically utilized wood or metal frames to provide stability and rigidity to the shape of the furniture, namely the seat the back end the arm and sufficient structure to support the weight of a user. This traditional approach to furniture design has resulted in durable but generally heavy furniture that is difficult to move and to combine with other furniture to provide versatility in seating arrangements. More specifically seating that Includes upholstery is typically assembled by hand and typically starts with a core made out of plywood boxes so as to create and provide sufficient structure to support the attachment of the upholster cushions and the weight or the user. This type of assembly requires a great deal of manual labour, not only to make the core box, but also to achieve the desired upholstered finish. The upholstery is typically tacked onto the plywood boxes using staples or nails and does not allow for the ability to remove the upholstery.

Modular furniture systems are well known in the art and they have typically had a light weight construction and utilized a foam polyurethane core with a fabric cover to the reduce weight of the overall structure. While this construction helps reduce the weight of the furniture and makes it easier to move, it does not provide the required structure and rigidity to the furniture to support a person of average weight that is typically derived from wood or metal. As a result these foamed structures typically break down or degrade over a short period of time and provide insufficient support for the user.

Traditional modular furniture systems have also tried to include into one system a variety of seating structures, like individual seating, lounge seating, tables, and shelves for example. The versatility, lightweight aspects, and uniform assembly make modular furniture a popular choice to provide a variety of seating configurations and options to the end user. However to achieve these different configurations or options, existing modular furniture systems often require a different unit design for each aspect of the modular furniture system or different piece of furniture. Therefore each unit design must be individually fabricated to create the final piece of furniture, whether it is a seating unit, table or a seating lounge. As a result each mechanical fabrication of each unit design requires specific positioning, mechanical fastening, and the use of cumbersome tools. As such each unit design is not interchangeable, nor adaptable to form a different piece of furniture.

The present invention describes a modular furniture system that provides sufficient and equivalent support to a user as wood or steel, while being light weight, moveable and providing flexibility on the orientation and combination of different types of seating arrangements.

SUMMARY

In accordance with one aspect of the present invention there is provided a modular seating system including at least two horizontally oriented support members and at least one core base component of recycled plastic having a top and a bottom adapted to engage the horizontally oriented support members, wherein the plastic core base component includes a series of feature attachment points molded directly info the top and the bottom of the plastic core base component, and wherein the bottom of the plastic core base component includes defined receptacles for at least four vertical support members and support webbing.

Preferably the bottom of the core base component may further include at least two parallel channels that run the length of core base component wherein each channel is positioned on either side of hollow centre and each Is adapted to receive one horizontally-oriented support member.

In accordance with another embodiment of the present invention there is provided a modular seating system including at least two horizontally oriented support member at least one core base component of recycled plastic having a top and a bottom adapted to engage the horizontally oriented support members. The plastic core base component includes a series of feature attachment points molded directly into the top and the bottom of the plastic core base component. The modular seating system further includes a plastic core back component of recycled plastic having a front, a back, a top and a bottom adapted to engage the series of feature attachment points of the plastic core base wherein the bottom of the plastic core base component includes defined receptacles for at least four vertical support members and support webbing.

Preferably the core back component may further include a series of slots positioned around the sides and front of the core back component and adapted to receive upholstery webbing. The front of the core back component may also include at least two parallel channels positioned across the bottom from the front to the back of the core back component and each is adapted to receive one horizontally oriented support member.

In accordance with another preferred embodiment there is disclosed a modular seating system including at least two horizontally oriented support members, at least one core base component of recycled plastic having a top and a bottom adapted to engage the horizontally oriented support members, wherein the plastic core base component includes a series of feature attachment points molded directly into the top and the bottom of the plastic core base component.

The modular seating system may also include at least one core back component of recycled plastic having a front and a back adapted to engage the series of feature attachment points of the plastic core base component. The modular seating system may further include at least one core armrest component of recycled plastic having an inner side, an cuter side and a bottom adapted to engage the series of feature attachment points of the plastic core base component wherein the bottom of the plastic core base component includes defined receptacles for at least four vertical support members and the bottom of the plastic arm component includes defined receptacles for at least two vertical support members and support webbing.

Other aspects will be apparent from the description and drawings provided herein.

BRIEF DESCRIPTION OF DRAWINGS

A detailed description of the preferred embodiments are provided herein below by way of example only and with reference to the following drawings, in which.

Figure 1A:
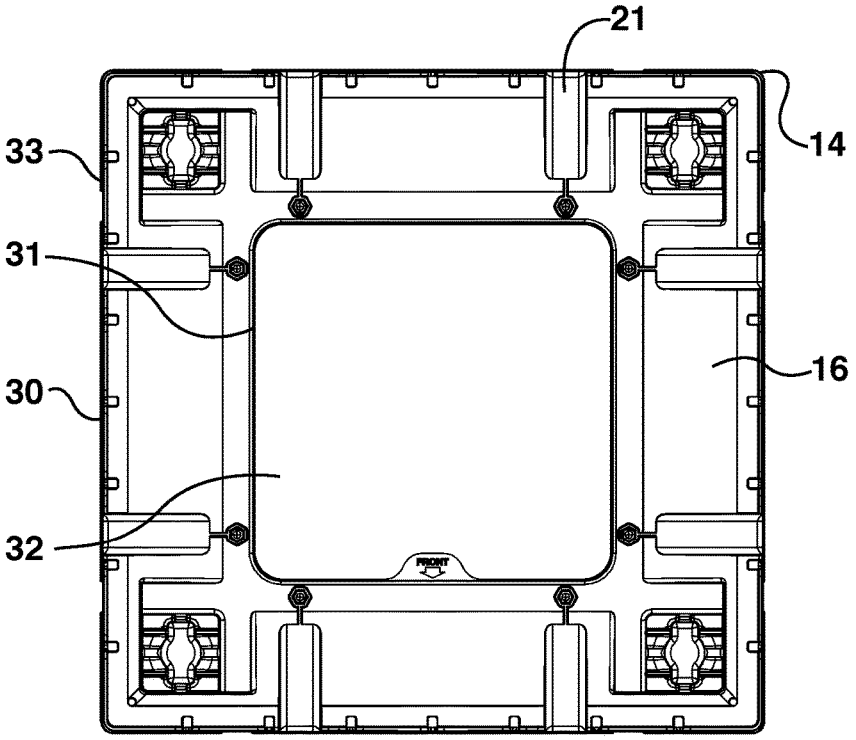
FIG. 1*a* is a top view of the plastic core base component.

In the drawings, preferred embodiments of the invention are illustrated by way of example. It is to be expressly understood that the description and drawings are only for the purpose of illustration and as an aid to understanding, and are not intended as a definition of the limits of the invention

DETAILED DESCRIPTION

Figure 1B:
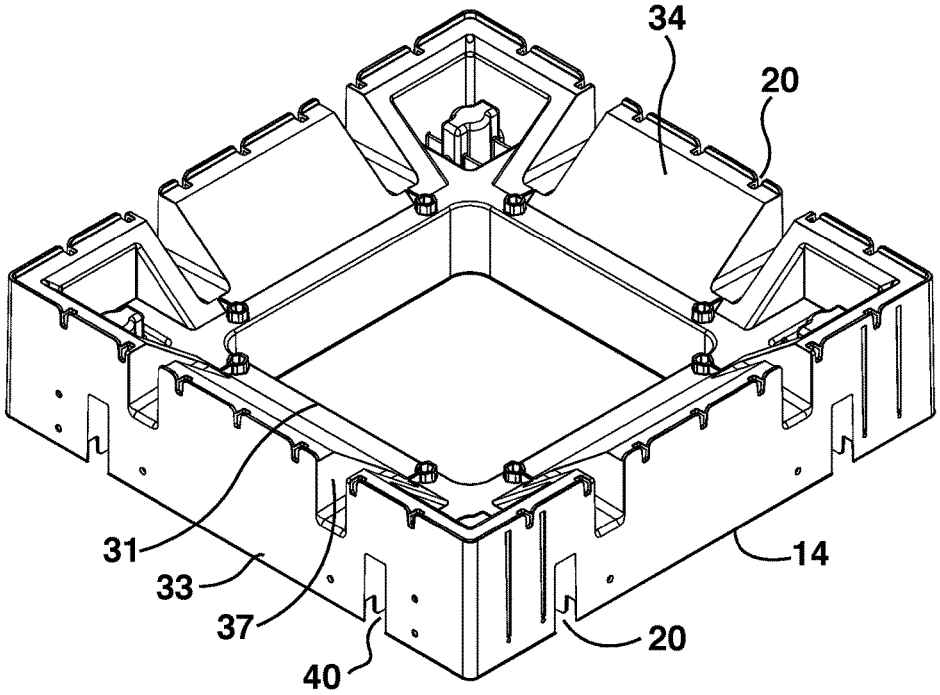
FIG. 1*b* is a perspective view of the plastic core base component.
Figure 1C:
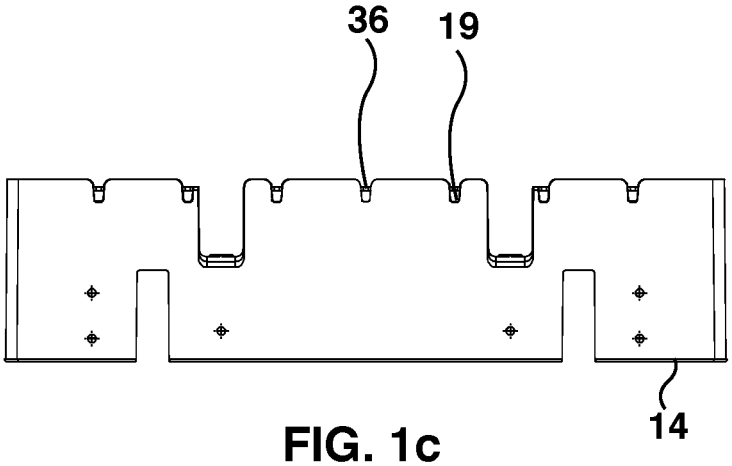
FIG. 1*c* is a front view of the plastic core base component.
Figure 1D:
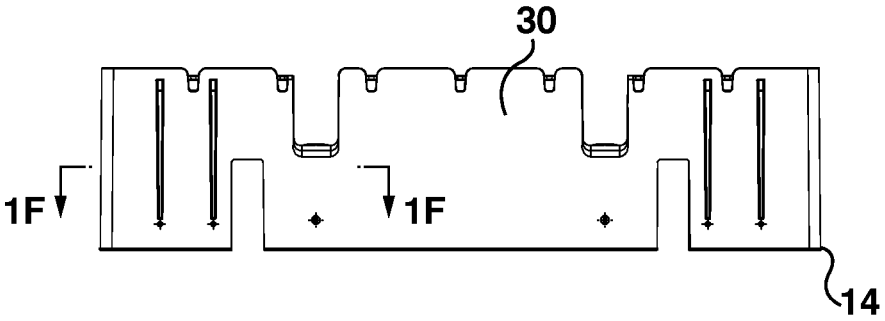
FIG. 1*d* is a side of the plastic core base component.
Figure 1E:
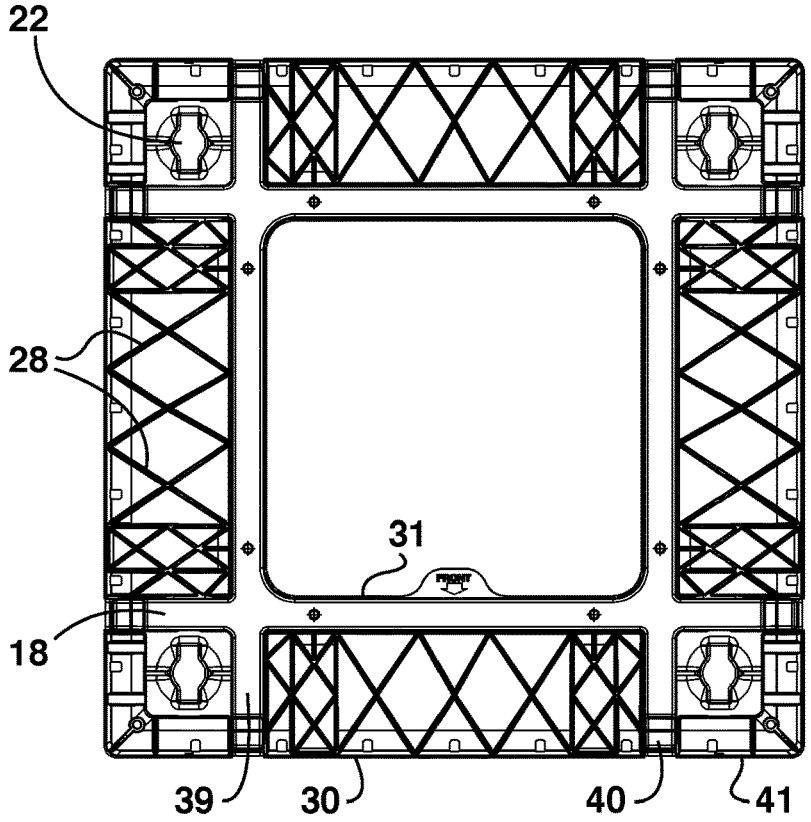
FIG. 1*e* is a bottom of the plastic core base component.
Figure 1F:
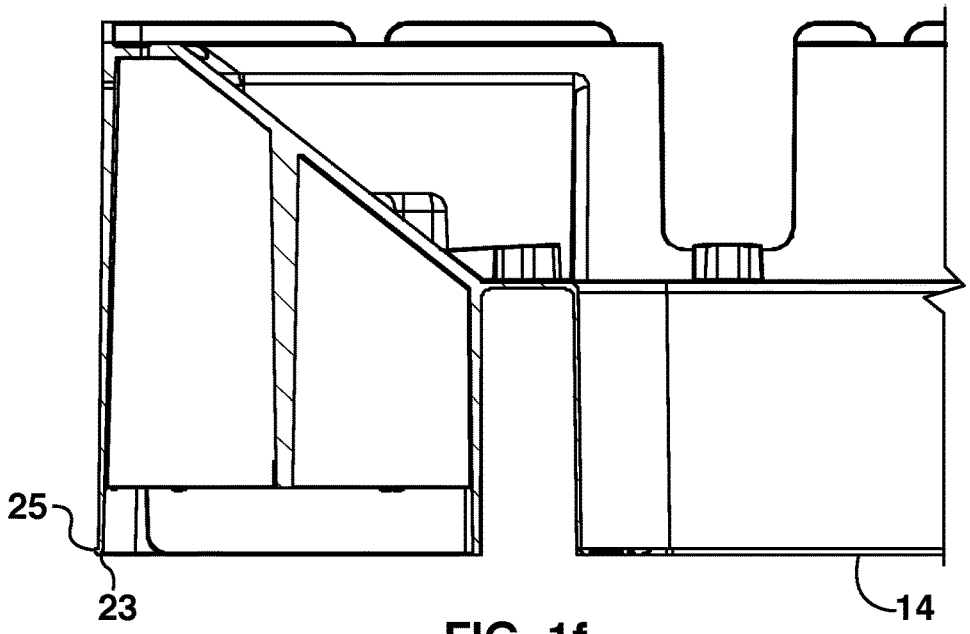
FIG. 1*f* is a cross-sectional of the plastic core base component along the lines**.
Figure 7A:
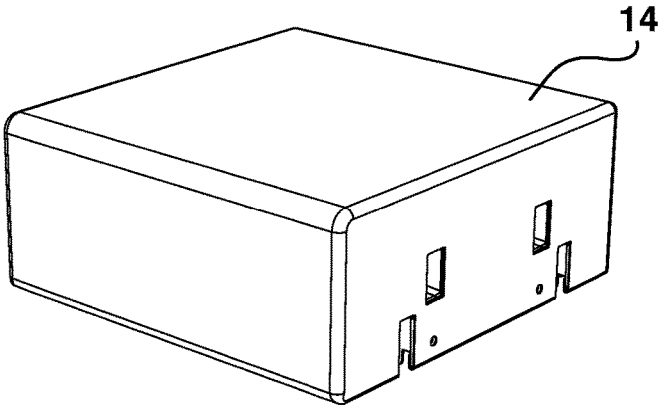
FIG. 7*a* to 7*d* are perspective views of the assembly of the modular seating system.
Figure 7B:
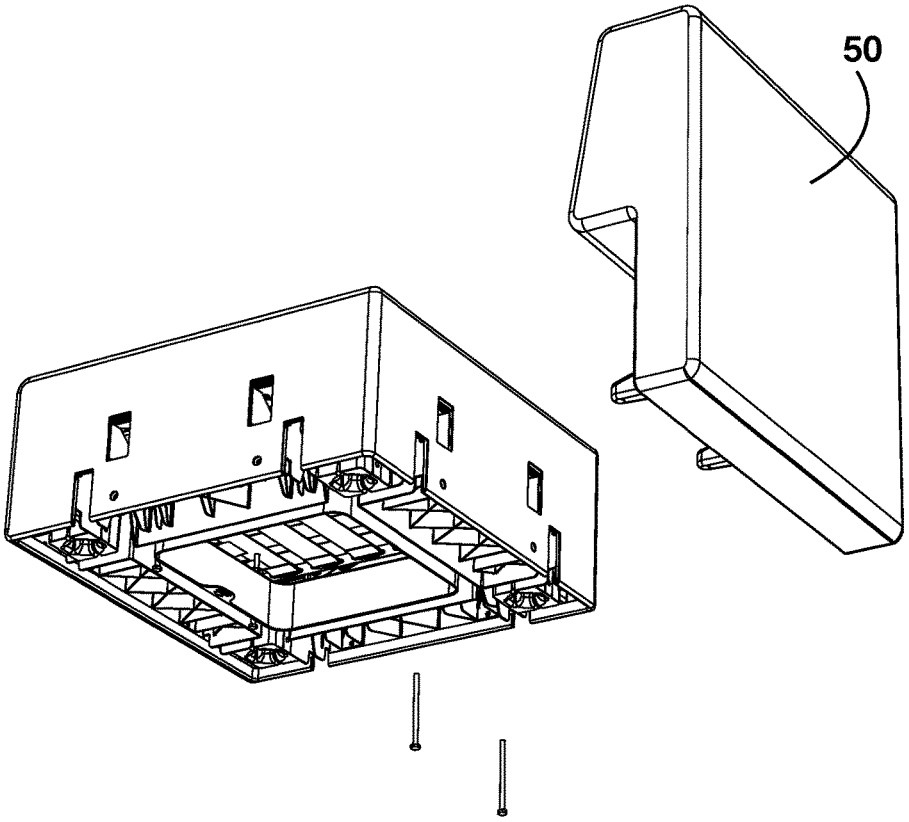
Figure 7C:
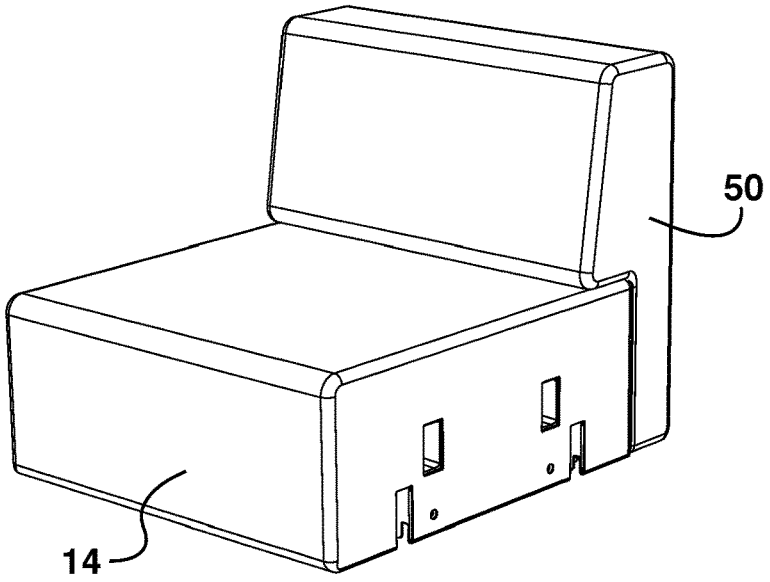
Figure 7D:
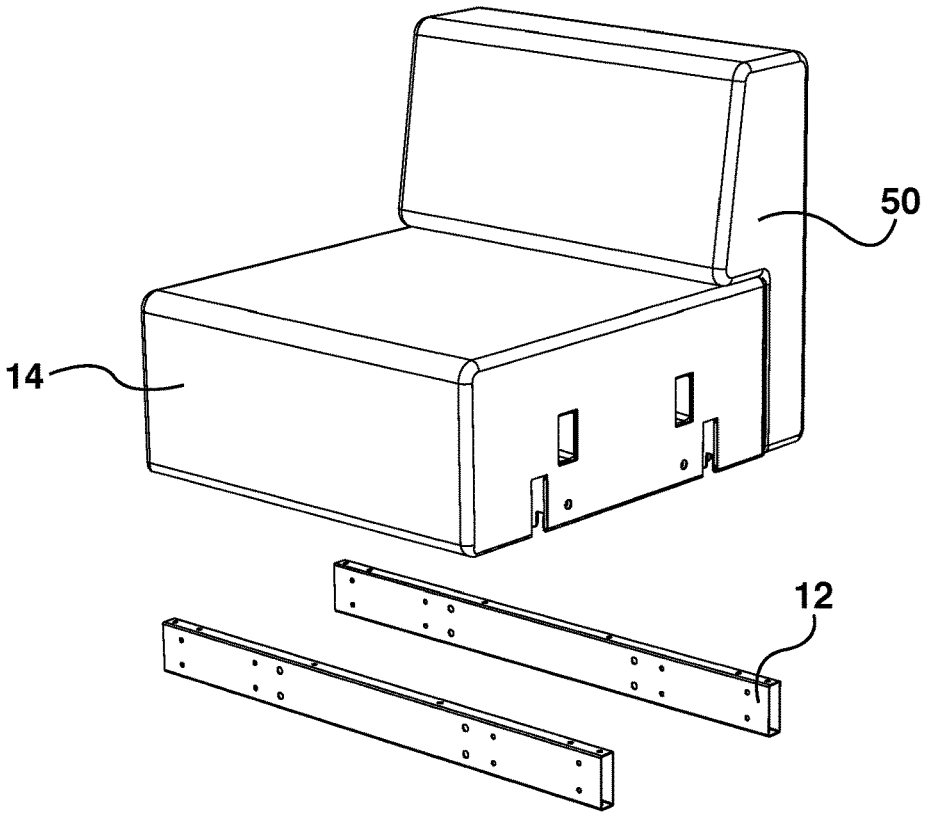

Referring to FIGS. 1*a* to 1*f* and FIGS. 7*a* to 7*d*, there is illustrated in a modular seating system 10 including at least two horizontally oriented support members 12 and at least one core base component 14 of recycled plastic. The core base component 14 may have a top 18 and a bottom 18 that are adapted to engage the horizontally oriented support members 12. The plastic core base component 14 may further include a series of feature attachment points 20 molded directly into the top 10 and the bottom 18 of the plastic core base component 14. The bottom 18 of the plastic core base component 14 may further include defined receptacles 22 for at least four vertical support members 24 and support webbing 28.

The horizontally oriented support members 12 may be further defined as tube shaped, having a diameter ranging from half an inch to 6 inches. Furthermore the horizontally oriented support members 12 may be of varying lengths, and have a maximum span of 120 inches. The horizontally oriented support members 12 may have a variety of profiles, including circular, oval, rectangular or square, and may be hollow or solid by way of example. Furthermore the horizontally oriented support members 12 may preferably be made from steel or an equivalently strong material with a gage of 17 to 11.

The core base component 14 may be further include at least four sides 30 and a hollow centre 32. The core base component 14 may therefore have the outline of a square or rectangle by way of example only. As such the core base component 14 includes four inner sides 31 and four outer sides 33.

Figure 4A:
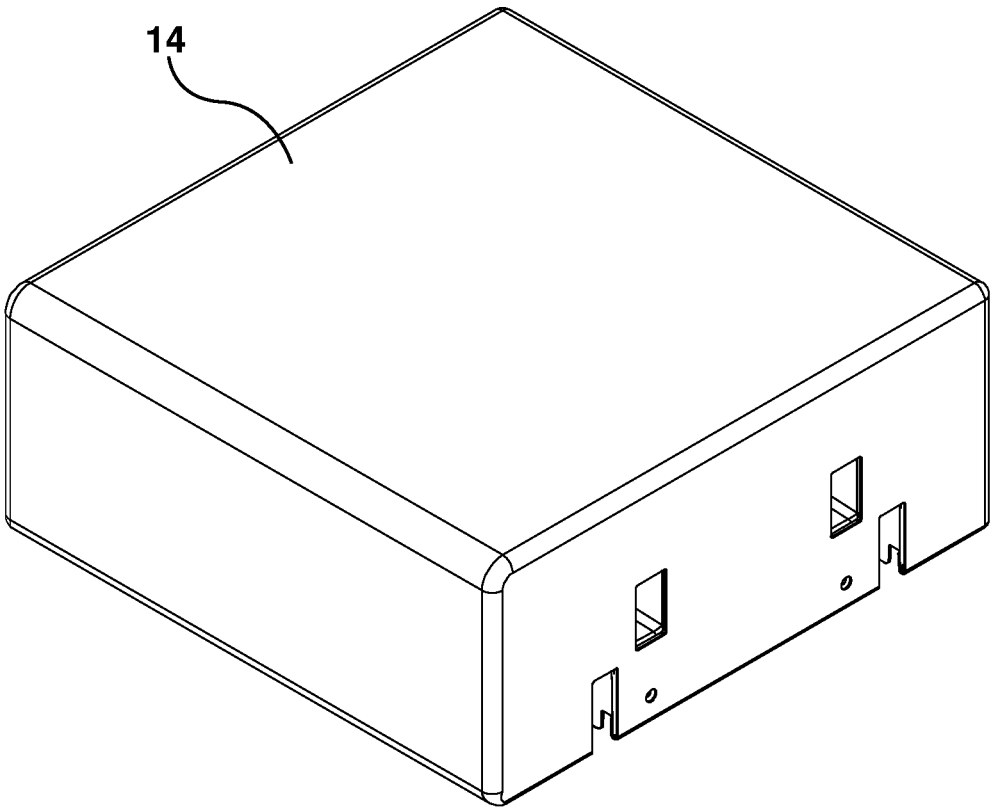
FIG. 4*a* is a perspective view of the assembled plastic core base component.
Figure 4B:
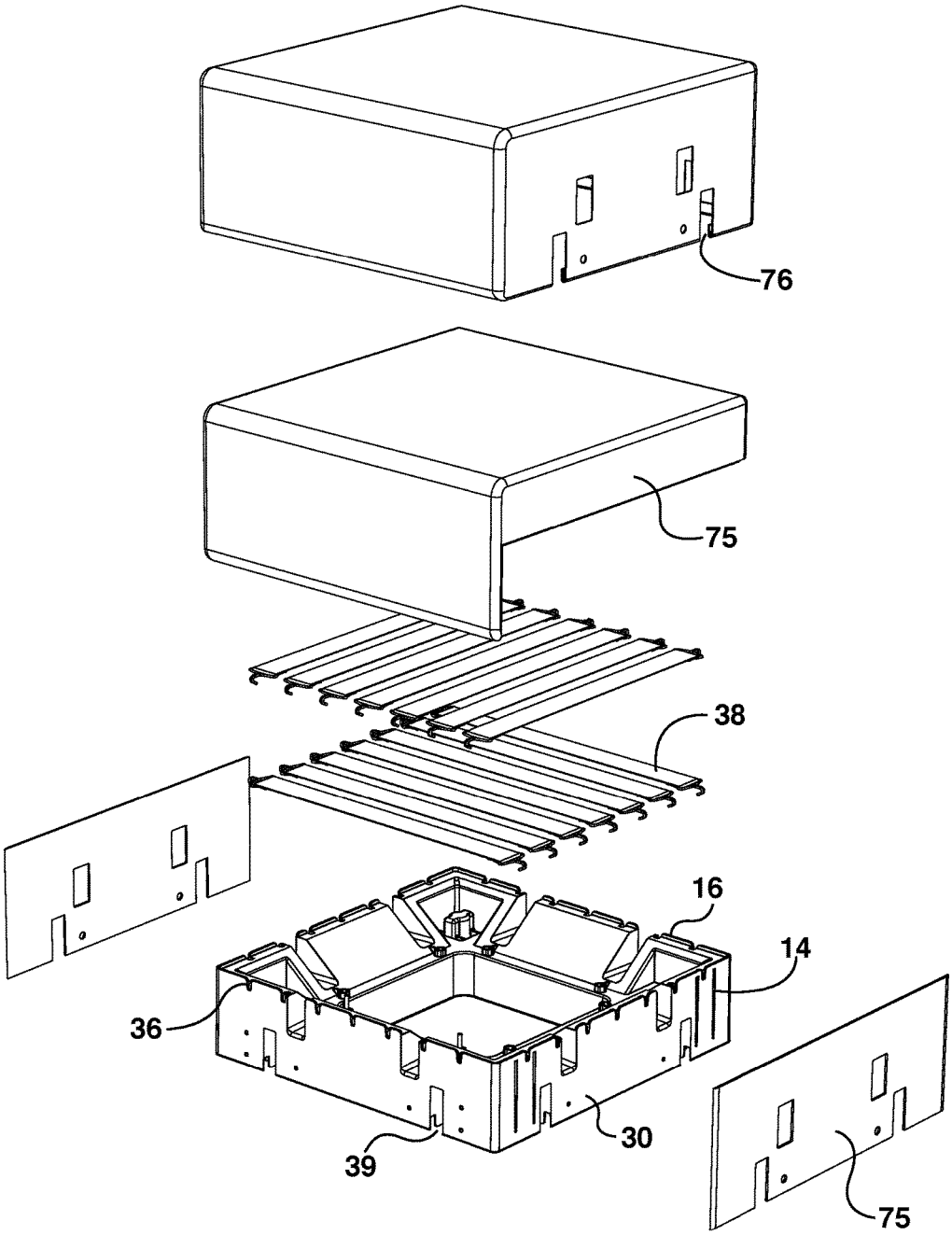
FIG. 4*b* is an exploded view of the assembled plastic core base component.

The core base component 14 may be further defined as an armature that provides sufficient strength to support a person. The core base component 14 may be made from recycled plastic. More specifically this recycled plastic is injection moulded to the desired shape outlined in FIGS. 1*a* to 1*e* and FIG. 4. The top 16 and the sides 30 of the core base component 14 include sloping walls 34 towards the hollow centre 32 to provide additional structure and support to the modular seating system 10.

The series of feature attachment points 20 may include a first series of feature attachment points 19 namely slots 36 positioned around the top 16 and more specifically around the sides 30 of the core base component 14. The slots 36 act as receptacles or attachment points for upholstery webbing 38 during the construction of the modular seating system 10.

A second series of feature attachment points 21 may include a first series of apertures 3 positioned at spaced intervals around the sides 30 of the core base component 14. The second series of feature attachment points 21 may also include points of attachment for screens or tables like ridges or clips.

The first series of apertures 37 are adapted to engage additional and neighbouring core components of the module seating system 10. More specifically the apertures 37 are adapted to receive the core back components 50 for example. The insertion of at least two support arms 84, by way of example only, info the apertures 37 allows for the securement of these additional elements to core base component 14. These additional elements can vary to include an arm rest table, screen or additional base components.

A third series of feature attachment points 23 may be defined as attachment zones 25 that are adapted to accept reciprocating extrusions. The attachment zones 25 may be better defined as a ridges that allow for the connection to extrusions for the easy attachment of upholstery to the core base component 14.

The support webbing 28 on the bottom 18 of the core base component 14 may be positioned along the four sides 30, and reflects the positioning of the underside of the sloping walls 34. The bottom 18 of the core base component 14 may further include at least two parallel channels 38 that run the length of the four sides 30, wherein each channel is positioned on either side of hollow centre and are adapted to receive the horizontally oriented support members 12. The channels 39 may be positioned on the bottom 18 of the core base component 14 so as to run adjacent the inner sides 31. As the channels 39 run across the entire length of the four sides 30, the outer sides 33 include a second series of apertures 40 where the channels 39 exit. As such when the horizontally oriented support members 12 are positioned within the channels 39, there is a support member 12 on either side of the hollow centre 32. By running the channels 39 adjacent to each of the inner sides 31, the core base component 14 may be oriented in different directions, while continually being supported by the horizontally oriented support members 12.

The receptacles 22 may be positioned in the corners where the four sides 30 meet. The four vertical support members 24 may be further defined as seating legs, and may include a variety of shapes and orientations. For example, the vertical support members 24 may be tubular shaped, or round and may be straight or bent. The vertical support members 24 may be friction fit Into the receptacles 22 and secured with fasteners.

Figure 2A:
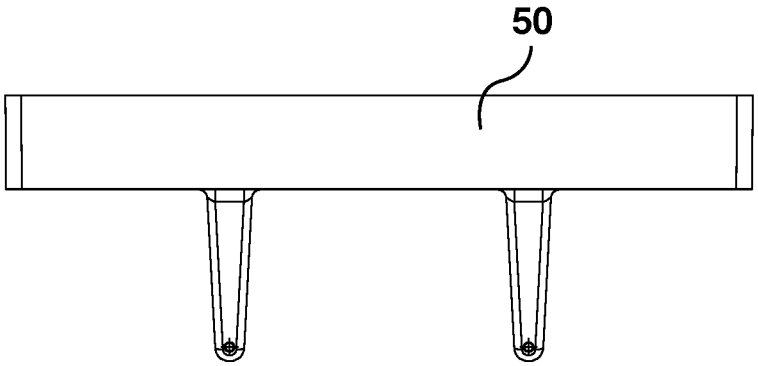
FIG. 2*a* is a top view of the plastic core back component.
Figure 2B:
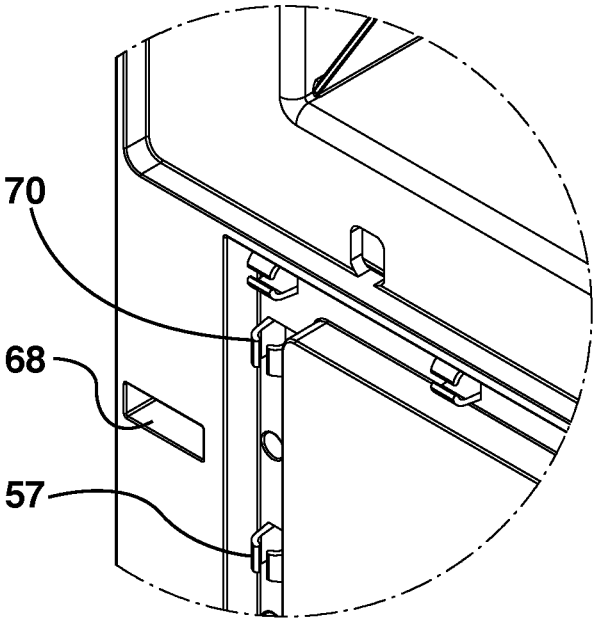
FIG. 2*b* is a close up view of the plastic core back component of FIG. 2*d;*
Figure 2C:
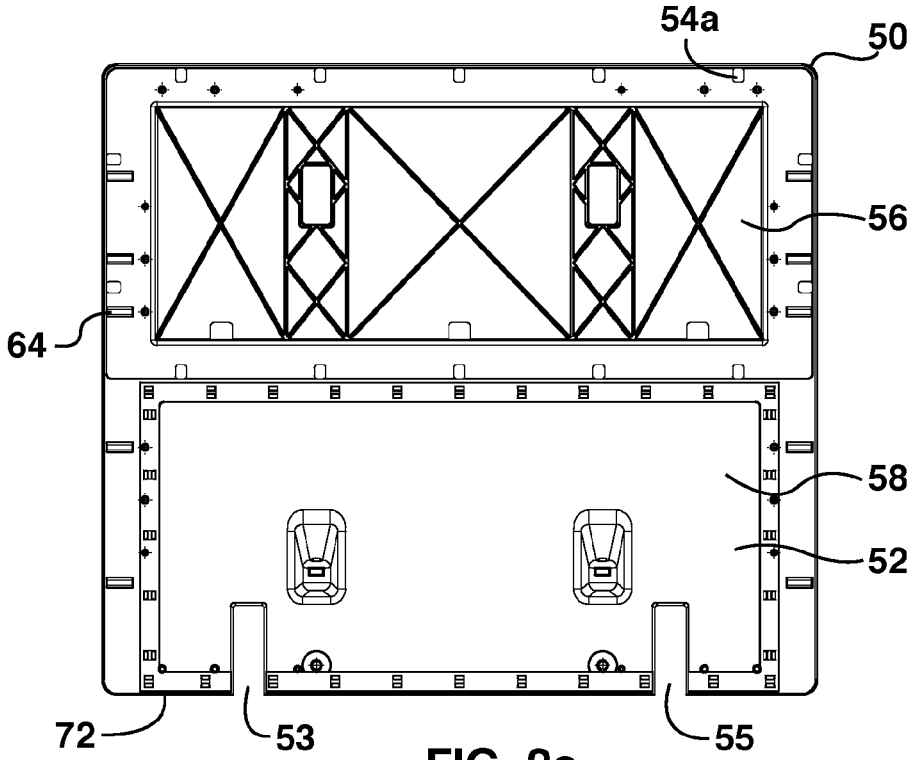
FIG. 2*c* is a front view of the plastic core back component.
Figure 2D:
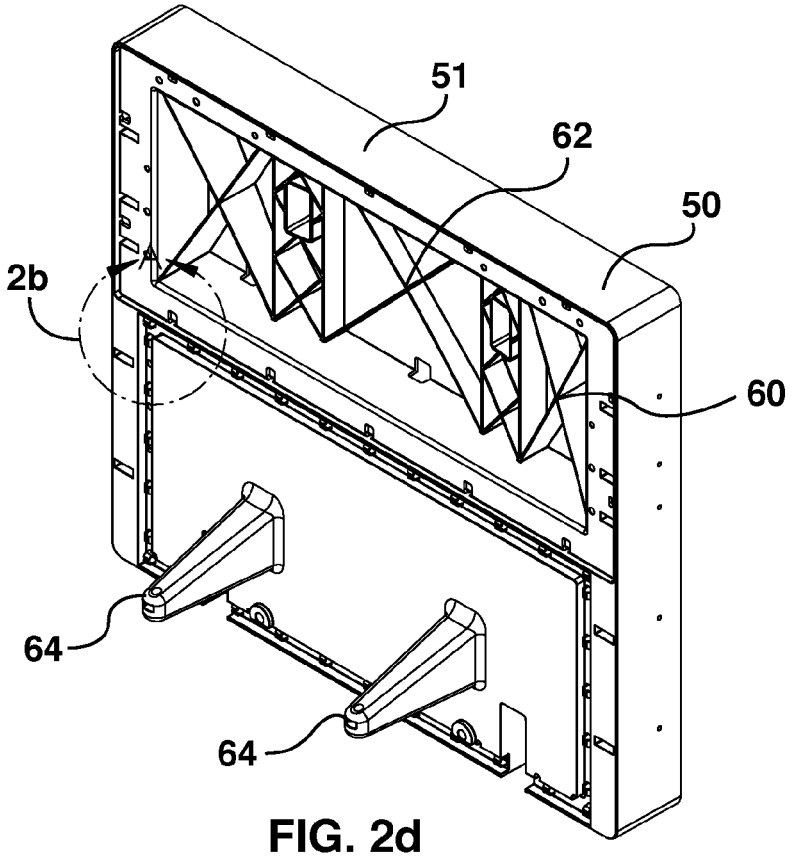
FIG. 2*d* is a perspective view of the plastic core back component.
Figure 2E:
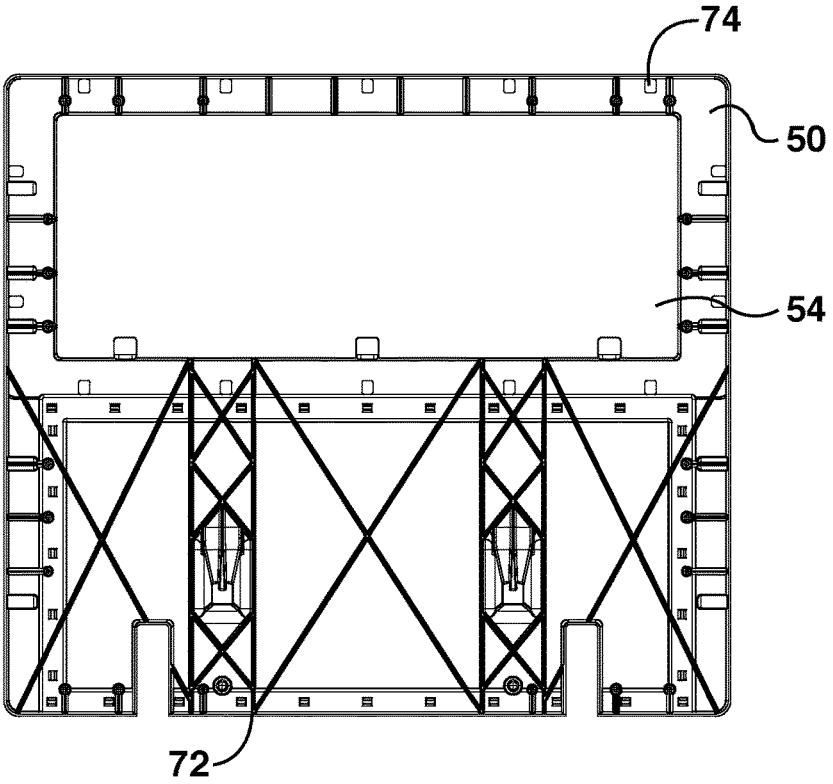
FIG. 2*e* is a perspective view of the plastic core back component.
Figure 2F:
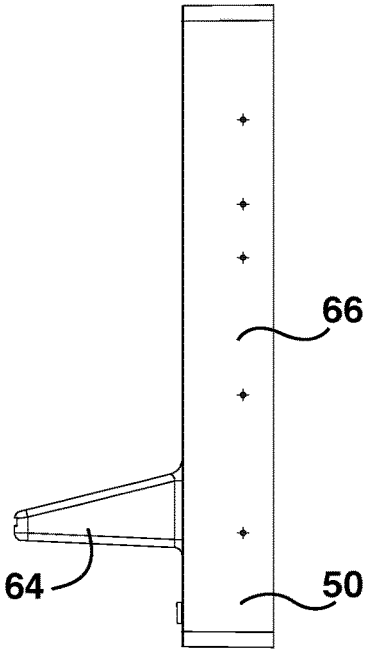
FIG. 2*f* is a sloe view of the plastic core back component.
Figure 5A:
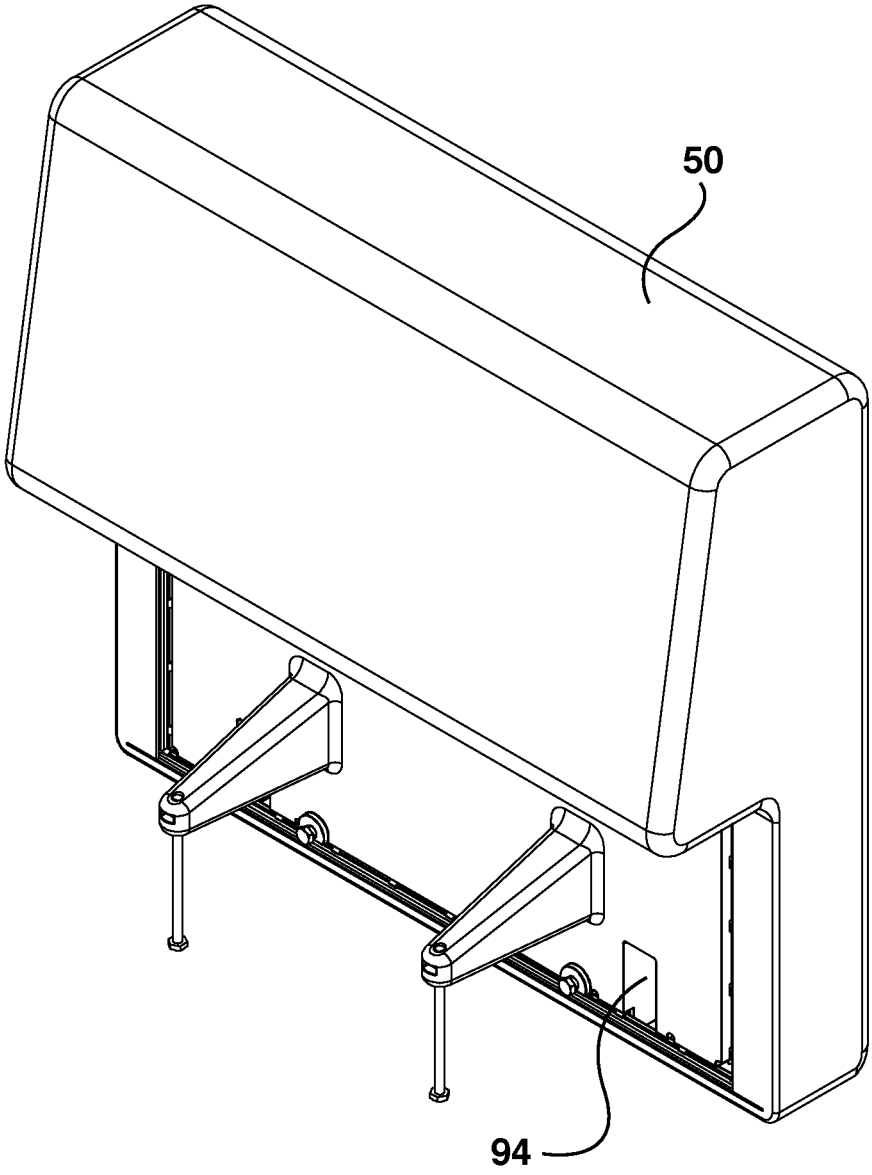
FIG. 5*a* is a perspective view of the assembled plastic core back component.
Figure 5B:
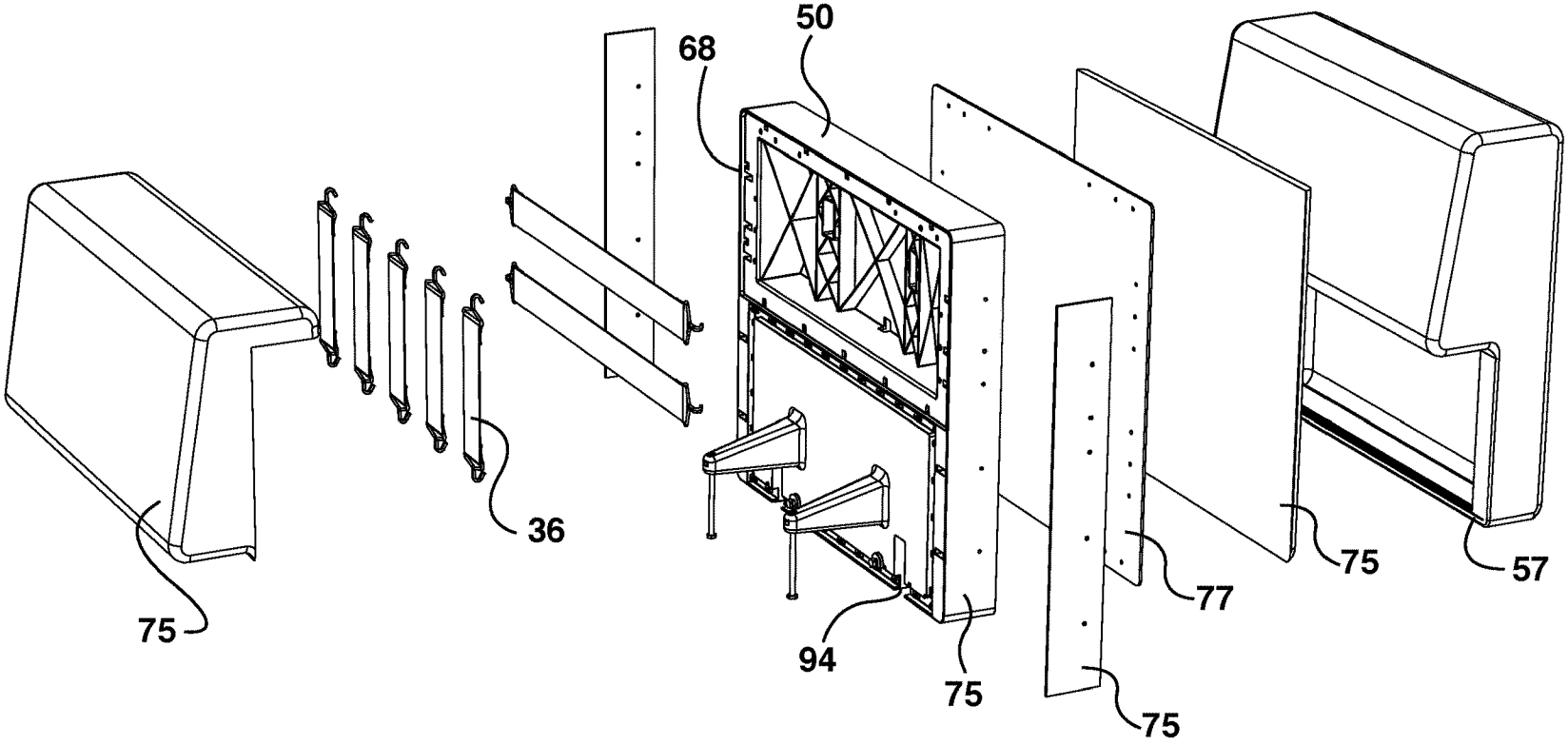
FIG. 5*b* is an exploded view of the assembled plastic core back component.

Referring to FIGS. 2*a* to 2*f* and 5*a* and 5*b*, the modular seating system 10 may further include at least one core back component 50 of recycled plastic having a front 62, a back 54, a top 51 and a bottom 72 adapted to engage the feature attachment points 20 of the plastic core base component 14.

More specifically the front 52 may be further defined as having an upper portion 56 and a lower portion 58. The upper portion 58 may Include support webbing 80 and support walls 62. The lower portion 58 may Include at least two support arms 64 that are adapted to engage the second series of feature attachment points 21 of the core base component 14, namely the first series of apertures 37 around the sides 30 of the core base component 14.

The core back component 50 may further include a fourth series of feature attachment points 53 molded directly across the bottom 72 of the plastic core back component 50. The fourth series of feature attachment points 53 may Include a second series of at least two parallel channels 55 and are adapted to receive the horizontally oriented support members 12.

The plastic core back component 50 may further include a fifth series of feature attachment points 74 molded directly into the front 52 and the back 54 of the plastic core back component 50. The fifth series of feature attachment points 74 may include a second series of slots 68 positioned around the front 52 and more specifically around the sides 66 of the core back component 50. The slots 68 act as receptacles or attachment points for upholstery webbing 38 during the construction of the modular seating system 10.

A sixth series of feature attachment points 70 may be defined as a second series of attachment zones 57 that are adapted to accept reciprocating extrusions. The sixth series of attachment zones 70 may be better defined as clips that allow for the connection to extrusions for the easy attachment of upholstery to the core back component 50.

Figure 3A:
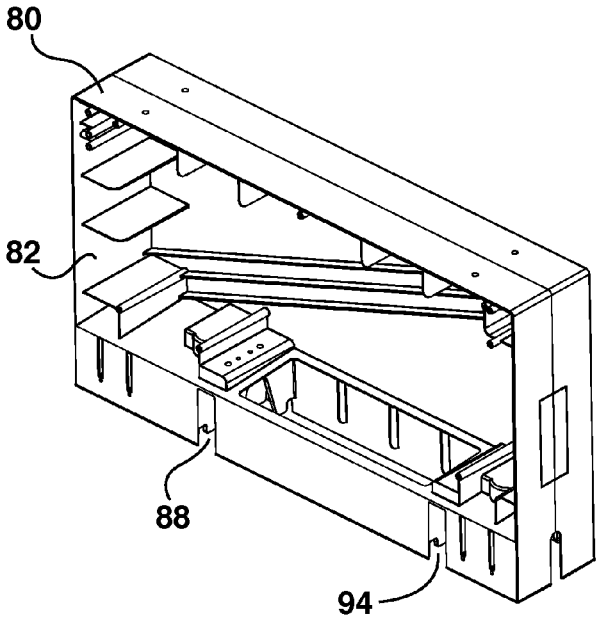
FIG. 3*a* is a left side perspective view of the plastic armrest component.
Figure 3B:
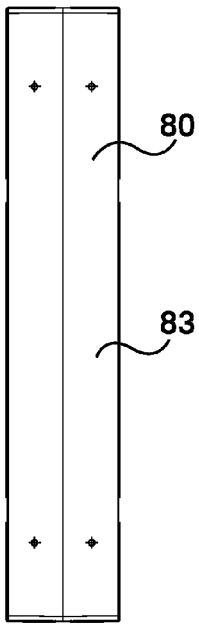
FIG. 3*b* is top view of the plastic core armrest component.
Figure 3C:
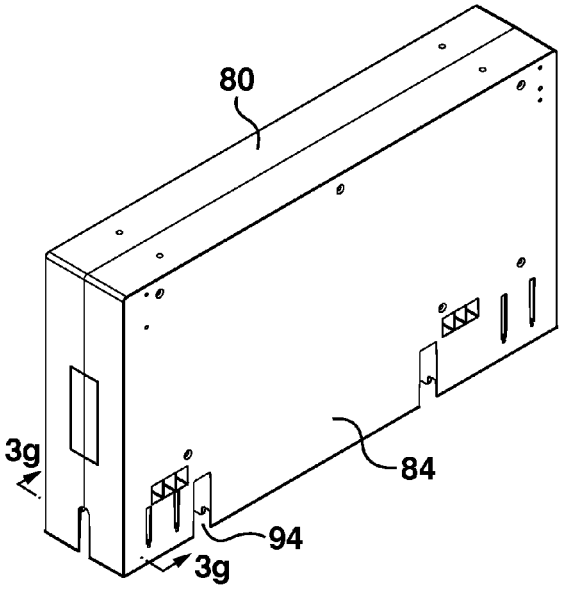
FIG. 3*c* is a right side perspective view of the plastic core armrest component.
Figure 3D:
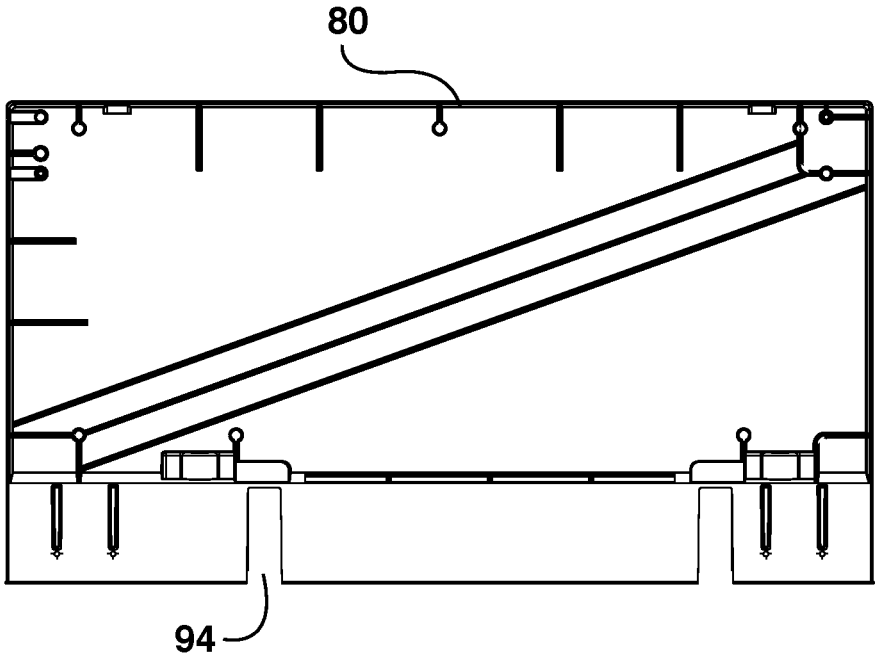
FIG. 3*d* is a left side view of the plastic core armrest component.
Figure 3E:
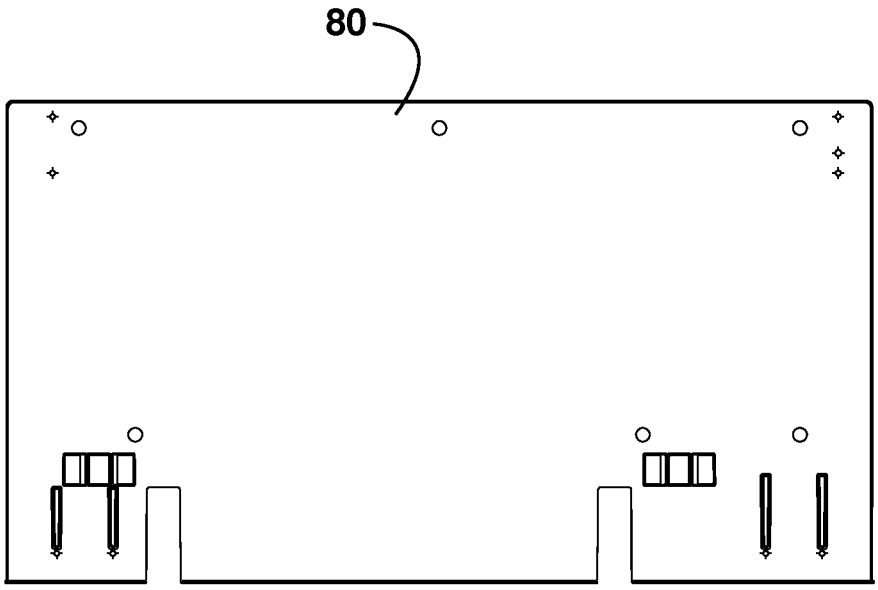
FIG. 3*e* is a right side view of the plastic core armrest component.
Figure 3F:
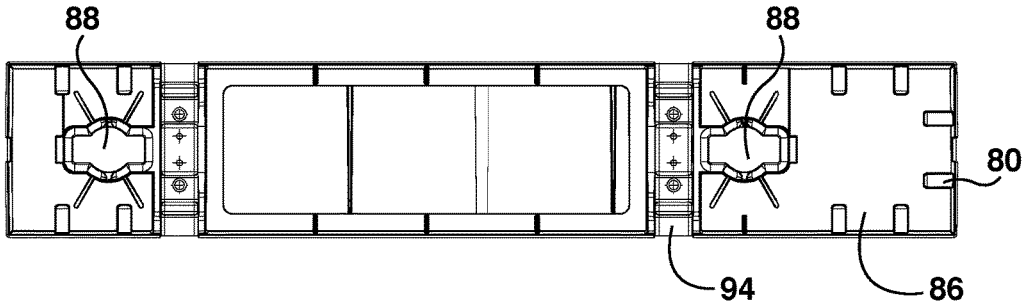
FIG. 3*f* is a bottom view of the plastic core armrest component.
Figure 3G:
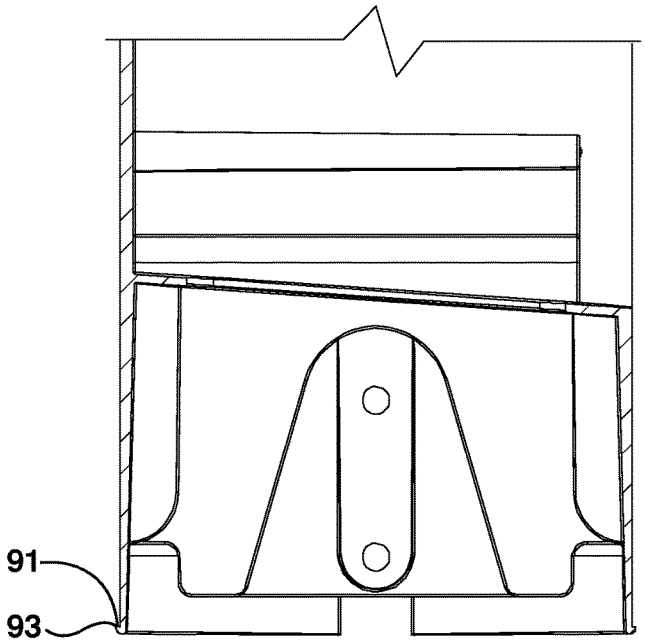
FIG. 3*g* is a cross-section view of the plastic core armrest component along the lines **.
Figure 6A:
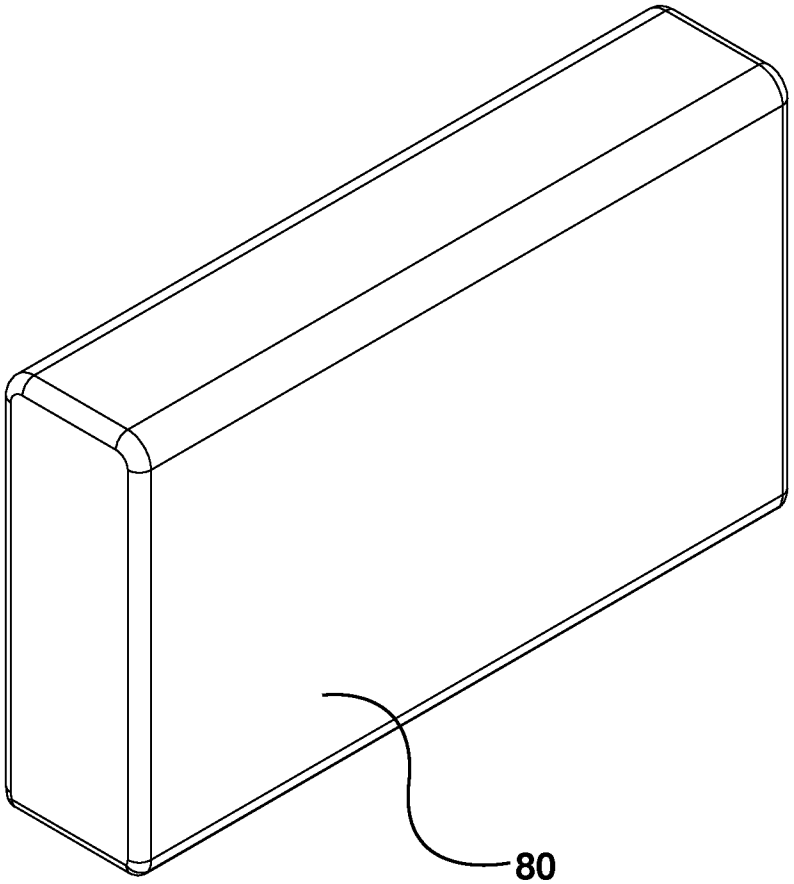
FIG. 6*a* is a perspective view of the assembled plastic core armrest component.
Figure 6B:
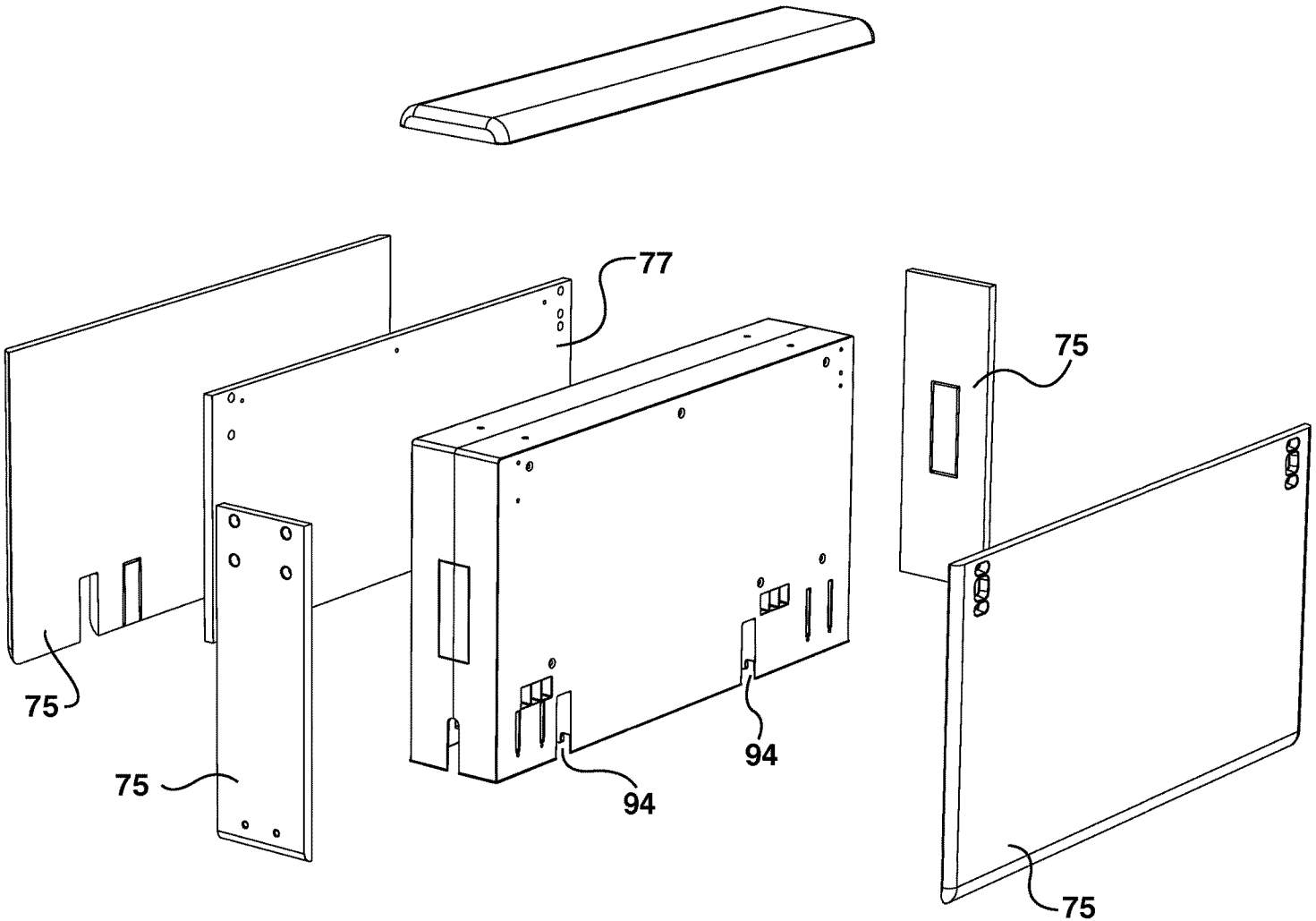
FIG. 6*b* is an exploded view of the assembled plastic core armrest component.

Referring to FIGS. 3*a* to 3*g* and 6*a* and 6*b*, the modular seating system 10 may further include at least one core armrest component 80 made from recycled plastic. The core armrest component 80 may Include an inner side 82, an outer side 84, a top 83 and a bottom 86 adapted to engage the series of feature attachment points 20 of the plastic core base component 14.

The plastic core armrest component 80 includes a seventh series feature attachment points 88 molded directly into the inner side 82, the outer side 84 and the bottom 86 of the plastic core armrest component 80. The seventh series of feature attachment points 88 may also include a third series of at least two channels 94 positioned across the bottom 86 of the plastic core armrest component 80 and run the width of the bottom 86 of the plastic core armrest component 80. The channels 94 are therefore able to adapt to engage the horizontally oriented support members 12. The bottom of the plastic armrest component 80 may include defined receptacles 88 for at least two vertical support members 90.

A eighth series of feature attachment points 91 may be defined as a third series of attachment zones 93 that are adapted to accept reciprocating extrusions. The third series of attachment zones 93 may be better defined as ridges or clips that allow for the connection to extrusions for the easy attachment of upholstery to the core armrest component 80.

Figure 8A:
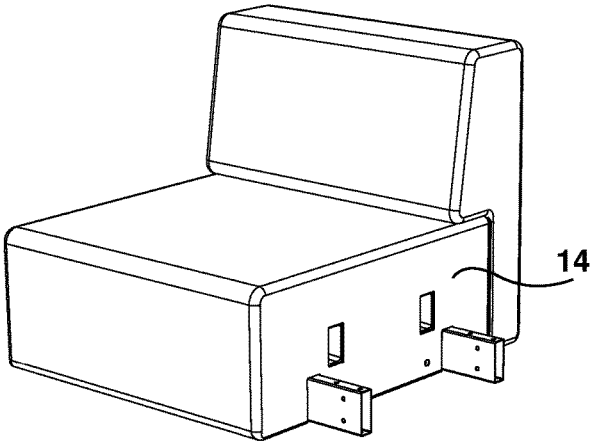
FIG. 8*a* to 8*d* are perspective views of the assembly of the modular seating system.
Figure 8B:
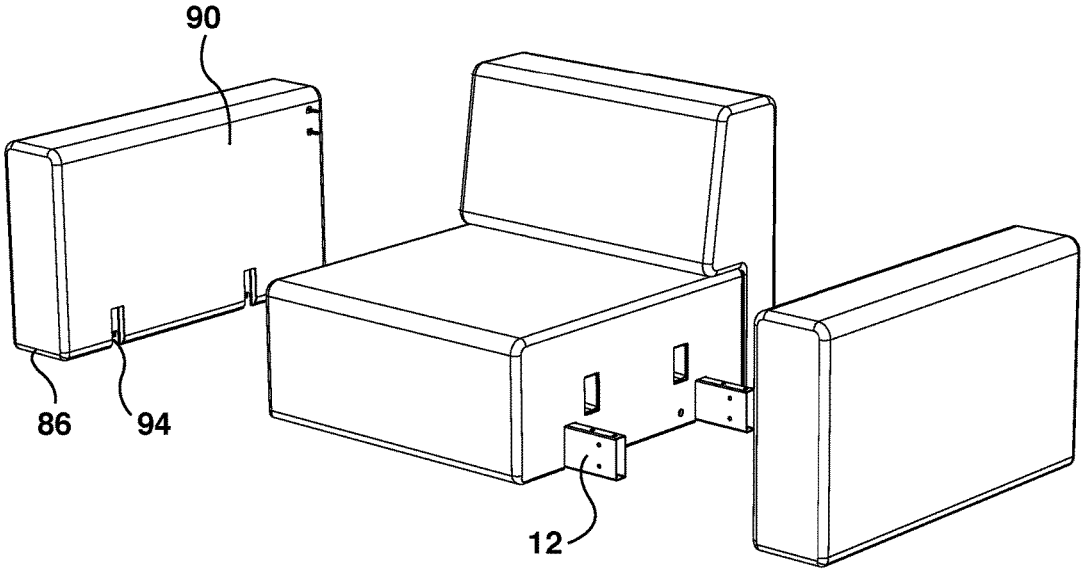
Figure 8C:
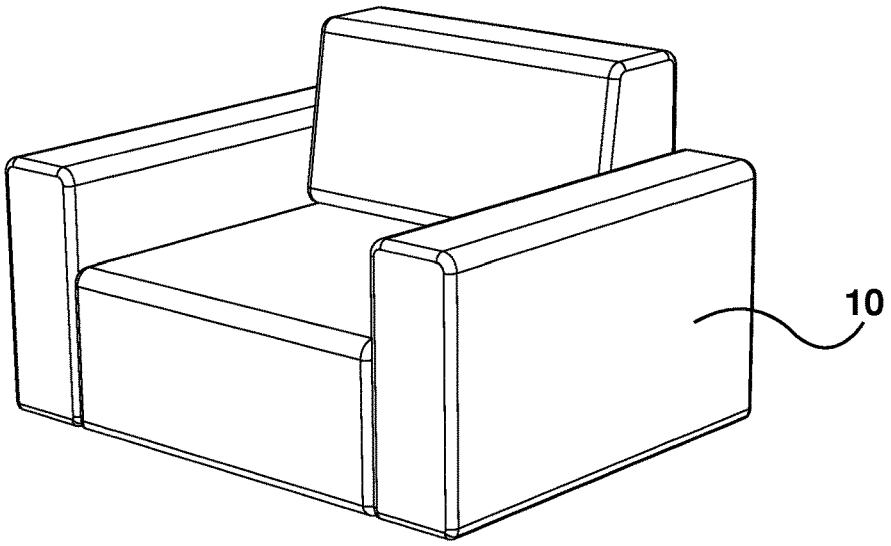
Figure 8D:
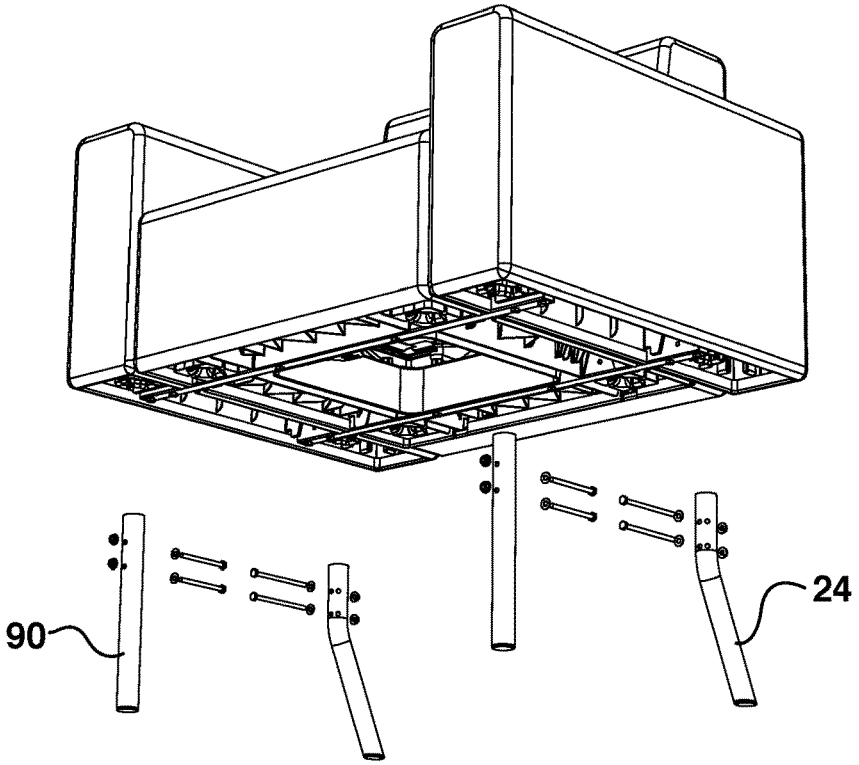
Figure 9A:
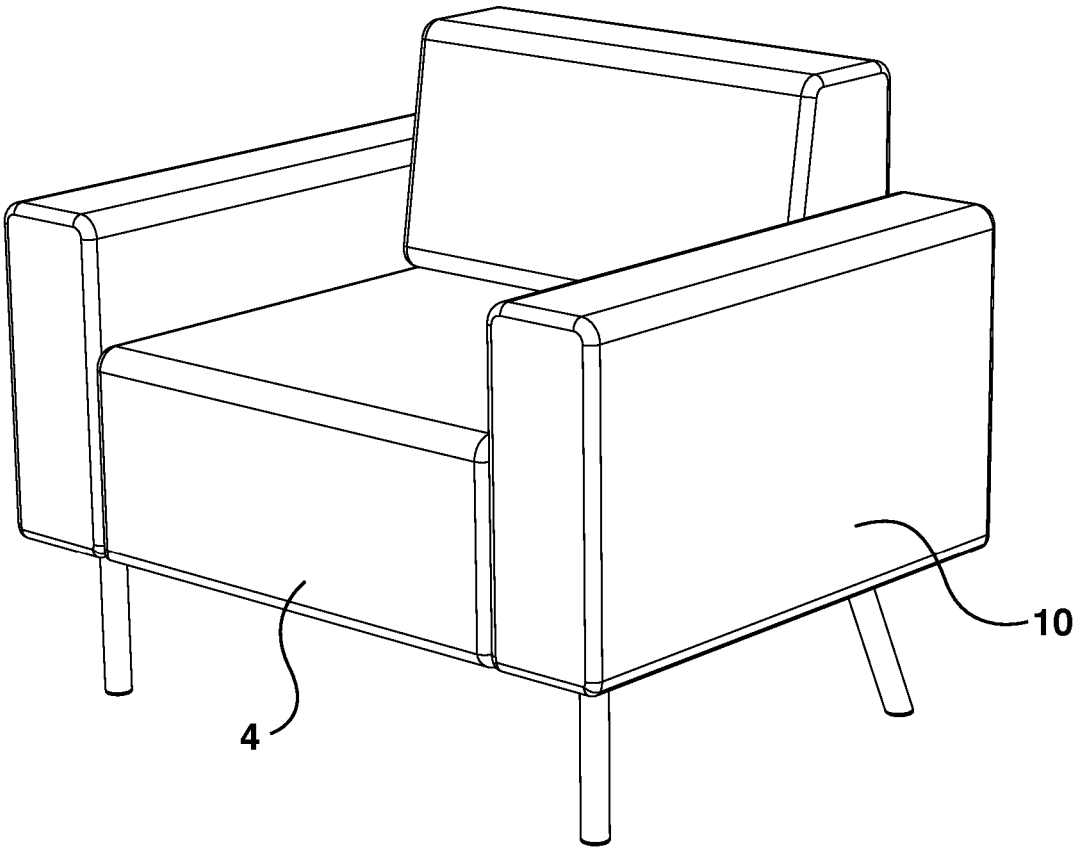
FIG. 9*a* to 9*c* are perspective views of the attachment of screens attached to the modular seating system.
Figure 9B:
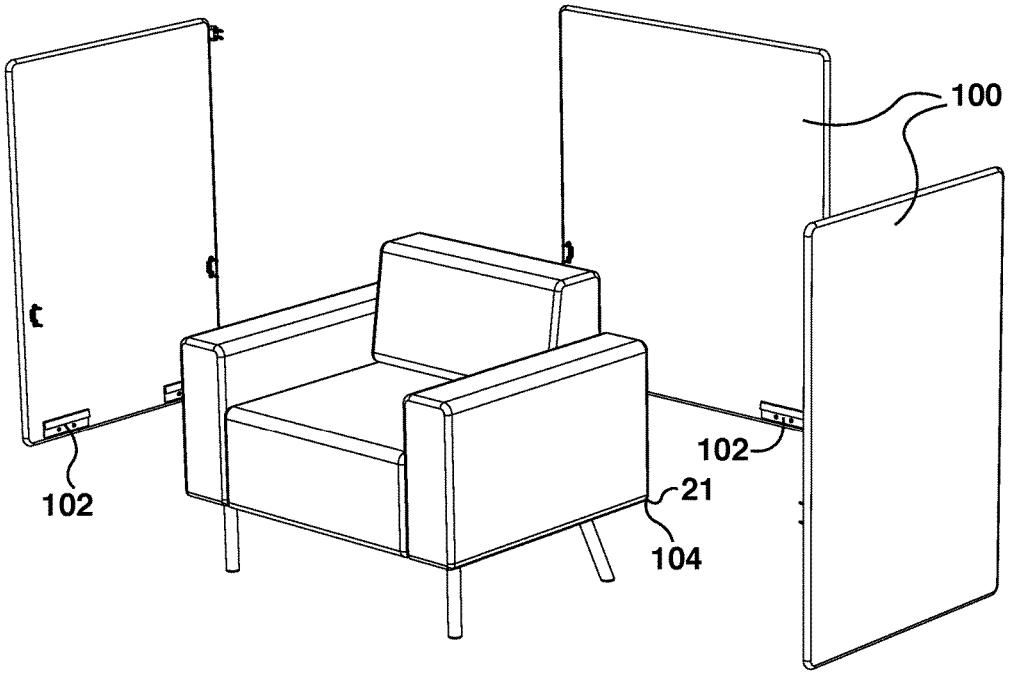
Figure 9C:
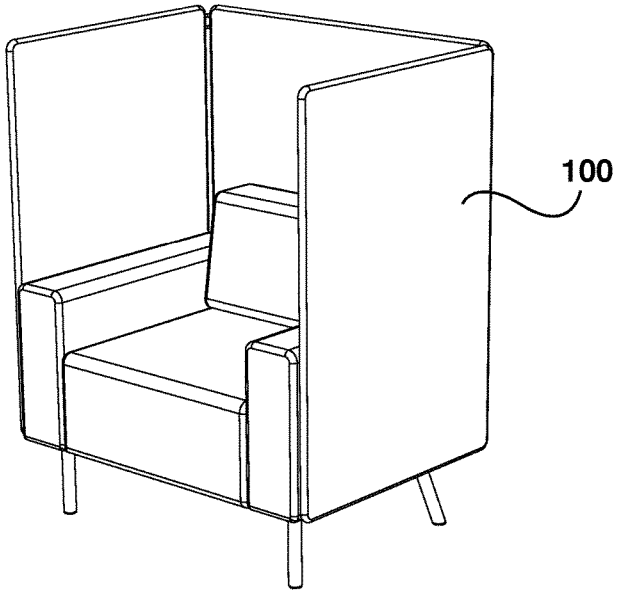

Referring to FIGS. 4 to 9*c*, in assembly, the modular seating system 10 includes first assembling the core base component 14. Typically this assembly includes positioning the upholstery webbing 38 within the slots 36 across the top 16 of the core base component 14. Molded foam 75 is then positioned around the top 16 and required sides 30 of the core base component 14. The desired upholstery may them positioned around the foam. The upholstery may further include the reciprocating extrusions or complimentary points of attachment 76 to the third series of feature attachment points 23 or attachment zones 25. For example the attachment zones 25, when defined as a ridge, allows for an attachment point 76 for the connection to an extrusion on the upholstery for the easy attachment of upholstery to the core base component 14.

Where a single core base component 14 is being assembled, four vertical support members 24 may be positioned in the four individual receptacles 22 thereby providing support for the core base component 14. When the modular seating system includes more than one single core base component 14, the bottom 18 of the core base component 14 is positioned over the two horizontally oriented support members 12. More specifically the support members are positioned within the parallel channels 39 that run across the bottom 18 of the core base component 14.

The horizontally oriented support members 12 may be the length of the core base component 14 or they may extend beyond the bottom 18 of the core base component 14 out of the apertures 37 positioned on the sides 30 of the core base component 14. The lengths of the support members 12 may customized to the desired length of the modular seating system 10.

When assembling a chair or seating structure requiring a back, the plastic core back component 50 may be assembled first separately. Typically this assembly includes positioning the upholstery webbing 38 within the second series of slots 68 positioned around the front 52 and more specifically around the sides 66 of the core back component 50. Molded foam 75 is then positioned around the front 52, the sides 66, the top 51 and the back 54 of the core back component 50. Additional support may added at the back 54 in the form of a board 77 if required.

The desired upholstery may them positioned around the foam. The upholstery may further include the reciprocating extrusions or complimentary points of attachment to the sixth series of feature attachment points 70 and the second attachment zones 57. For example the attachment zones 57 when defined as a ridge allows for an attachment point for the connection to an extrusions on the upholstery for the easy attachment of upholstery to the core back component 50. The extrusions on the upholstery may be integrally part of the upholstery itself or added mechanically to the upholstery.

The two support arms 64 of the lower portion 58 of the front 52 of the plastic core back component 50, may be positioned within the apertures 37 of the top 16 of the core base component 14. The two support arms 64 may then be secured with fasteners to the core base component 14.

When assembling a chair or seating structure requiring arms, the inner side 82 of the plastic core arm component 80 may be positioned towards the core base component 14, whereby the horizontally oriented support members 12 that extend beyond the core base component 14 engage the channels 94 that run the width of the bottom 86 of the plastic core armrest component 80.

When assembling a chair or seating structure requiring arms, the vertical support members 90 may be moved from, the receptacles 22 that are part of the plastic core base component 14 to the receptacles 88 of the plastic core armrest component 80. The two vertical support members 90 are therefore positioned in each of the receptacles 88 positioned in each plastic core armrest component 80 on either side of the core base component 14. Additional upholstery may be adhered to the core base component 14, the core back component 50 and the core armrest component 80.

The modular seating system 10 can further Include other components such as tables and privacy screens that can attach directly to the core base component 14. Specifically the second series of feature attachment points 21 may also include points of attachment for screens or tables like ridges or clips, namely a third series of apertures 104 that can engage with a screen. More specifically a privacy screen 100 may defined as a panel having reciprocating attachment points 102 that connect and secure the panel to modular seating system 10.

The modular seating system 10 allows for complete flexibility with regards to the orientation and configuration of the various plastic core base, hack and armrest components. More specifically the plastic core base can be oriented in any way as it has the series of feature attachment points 20 positioned on all sides of the plastic core base 14. This allows for creative positioning of the bases relative to the back, vertical support members, tables, screens, and armrests. The lightweight nature of the core components or armatures allows for easy lifting, assembling and manipulating of the components.

The use of the feature attachment points 20 allows easy engagement by the user whether to either position a core component or remove and attach upholstery. The modular seating system 10 therefore becomes similar to a "plug and play" concept where there is dramatic flexibility in the configurations of the modular seating system 10. Furthermore the modular seating system 10 allows for easy removal of the upholstery either for cleaning or changing. The attachment zones allow for the various attachment mechanisms to be molded directly into the upholstery and corresponding or reciprocating zones of attachment like a ridge on the core component.

The molding of the core components in recycled plastic makes each component very cost effective in comparison to traditional wood or steel components. Typically the components can be injection molded with various feature attachment points 20 according to the component being made. The resulting component therefore acts as a supporting armature that can easily support the weight of a user without buckling of breaking. However the cost of producing each component is extremely low while allowing for significant increased flexibility of the end product both in positioning and combining with other components and with upholstery options.

The preceding discussion provides many example embodiments. Although each embodiment represents a single combination of inventive elements, other examples may include all possible combinations of the disclosed elements. Thus if one embodiment comprises elements A, B, and C, and a second embodiment comprises elements B and D, other remaining combinations of A, B, C, or D, may also be used.

The term "connected" or "coupled to" may include both direct coupling (in which two elements that are coupled to each other contact each other) and indirect coupling (in which at least one additional element is located between the two elements).

Although the embodiments have been described in detail, it should be understood that various changes, substitutions and alterations can be made herein.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to Include within their scope such processes, machines, manufacture, compositions of matter, means, methods, or steps As can be understood, the examples described above and illustrated are intended to be exemplary only. The invention is defined by the appended claims.

What is claimed is:

1. A modular seating system comprising:

a seat, the seat comprising:

at least two horizontally oriented support members;

at least one core base component of recycled plastic comprising;

a top and a bottom adapted to engage the at least two horizontally oriented support members;

a series of feature attachment points integral with and positioned on the top and the bottom of the at least one core base component;

at least four sides, four sloping inner walls and a hollow centre, and at least two parallel channels that run a length of the at least one core base component, wherein each of the at least two parallel channels are positioned on either side of the hollow centre, and each receives one horizontally oriented support member of the at least two horizontally oriented support members;

wherein the bottom of the at least one core base component includes defined receptacles positioned on an outer side of the at least two parallel channels to receive at least four vertical support members and support webbing.

2. A modular seating system as claimed in claim 1, wherein the at least one core base component further comprises a series of slots positioned around the at least four sides of the at least one core base component which are adapted to receive upholstery webbing.

3. A modular seating system as claimed in claim 2, wherein the at least one core base component further comprises a series of apertures positioned at spaced intervals which are adapted to receive a series of support arms or a series of extrusions.

4. A modular seating system as claimed in claim 3, wherein the at least one core base component further comprises a series of attachment zones which are adapted to receive reciprocating upholstery extrusions.

5. A modular seating system as claimed in claim 4, wherein the series of attachment zones are a series of ridges and clips.

6. A modular seating system as claimed in claim 5, wherein the at least one core base component further comprises molded foam and upholstery.

7. A modular seating system comprising:

a seat, the seat comprising:

at least two horizontally oriented support members;

at least one core base component of recycled plastic comprising;

a top and a bottom adapted to engage the at least two horizontally oriented support members;

a series of feature attachment points integrally molded directly to and positioned on the top and the bottom of the at least one core base component;

at least four sides, four sloping inner walls and a hollow centre; and at least two parallel channels that run a length of the at least one core base component, wherein each of the at least two parallel channels are positioned on either side of the hollow centre, and each receives one horizontally oriented support member of the at least two horizontally oriented support members;

at least one core back component of recycled plastic having a front, a back, a top and a bottom and adapted to engage the series of feature attachment points of the at least one core base component;

wherein the bottom of the at least one core base component includes defined receptacles positioned on an outer side of the at least two parallel channels to receive at least four vertical support members and support webbing.

8. A modular seating system as claimed in claim 7, wherein the front of the at least one core back component further comprises an upper portion and a bottom portion, wherein the upper portion has support webbing and support walls and the bottom portion has at least two support arms adapted to engage the series of feature attachment points of the at least one core base component.

9. A modular seating system as claimed in claim 8, wherein the front of the at least one core back component further comprises at least two parallel channels positioned across the bottom from the front to the back of the at least one core back component, and the at least two parallel channels are each adapted to receive one horizontally oriented support member of the at least two horizontally oriented support members.

10. A modular seating system as claimed in claim 9, wherein the at least one core back component further comprises a series of slots positioned around the at least four sides and front of the at least one core back component and are adapted to receive upholstery webbing.

11. A modular seating system as claimed in claim 10, wherein the at least one core back component further comprises a series of attachment zones adapted to receive reciprocating upholstery extrusions.

12. A modular seating system as claimed in claim 11, wherein the series of attachment zones are a series of ridges and clips.

13. A modular seating system as claimed in claim 12, wherein the at least one core base component further comprises molded foam and upholstery.

14. A modular seating system comprising:

a seat, the seat comprising:

at least two horizontally oriented support members;

at least one core base component of recycled plastic comprising;

a top and a bottom adapted to engage the at least two horizontally oriented support members;

a series of feature attachment points integrally molded directly to and positioned on the top and the bottom of the at least one core base component;

at least four sides, four sloping inner walls and a hollow centre; and at least two parallel channels that run a length of the at least one core base component, wherein each of the at least two parallel channels are positioned on either side of the hollow centre, and each receives one horizontally oriented support member of the at least two horizontally oriented support members;

at least one core back component of recycled plastic having a front, a back, a top and a bottom and adapted to engage the series of feature attachment points of the at least one core base component;

at least one core armrest component of recycled plastic having an inner side, an outer side, a top and a bottom and adapted to engage the series of feature attachment points of the at least one core base component;

wherein the bottom of the at least one core base component includes defined receptacles positioned on an outer side of the at least two parallel channels to receive at least four vertical support members, and the at least one core armrest component includes defined receptacles to receive at least two vertical support members and support webbing.

15. A modular seating system as claimed in claim 14, wherein the bottom of the at least one core armrest component further comprises at least two parallel channels positioned across the bottom from the inner side to the outer side of the at least one core armrest component, and each of the at least one core armrest component is adapted to receive one horizontally oriented support member of the at least two horizontally oriented support members.

16. A modular seating system as claimed in claim 15, wherein the at least one core armrest component further comprises a series of attachment zones adapted to receive reciprocating upholstery extrusions.

17. A modular seating system as claimed in claim 16, wherein the series of attachment zones are a series of ridges and clips.

18. A modular seating system as claimed in claim 17, wherein the at least one core base component further comprises molded foam and upholstery.

* * * * *